US005533211A

United States Patent [19]

Mehrens

[11] Patent Number: 5,533,211

[45] Date of Patent: Jul. 9, 1996

[54] SLIDABLY REPOSITIONABLE HAT

[76] Inventor: Douglas W. Mehrens, 7865 E. Keim Dr., Scottsdale, Ariz. 85250

[21] Appl. No.: 253,128

[22] Filed: Jun. 2, 1994

[51] Int. Cl.[6] ..... A42C 5/00

[52] U.S. Cl. ..... 2/195.1; 2/181; 2/182.1; 2/182.6

[58] Field of Search ..... 2/171, 171.1, 175.1, 2/175.5, 181, 182.1, 182.5, 182.6, 195.1, 195.6, 416, DIG. 11, 10; 24/587; 446/27

[56] References Cited

U.S. PATENT DOCUMENTS

| | | | |
|---|---|---|---|
| 1,648,551 | 2/1927 | Klein . | |
| 1,677,187 | 3/1927 | Leibson . | |
| 2,855,604 | 10/1958 | Austin | 2/171.1 |
| 3,737,918 | 6/1973 | Henschel et al. | 2/197 |
| 4,023,212 | 5/1977 | Huffman | 2/197 |
| 4,777,667 | 10/1988 | Patterson et al. | 2/199 |
| 4,815,148 | 3/1989 | Satterfield | 2/197 |
| 4,821,341 | 4/1989 | Baptiste | 2/10 |
| 5,070,545 | 12/1991 | Tapia | 2/195 |
| 5,091,994 | 3/1992 | Delane et al. | 2/195 |
| 5,091,995 | 3/1992 | Oates | 2/195 |
| 5,253,364 | 10/1993 | Robinson | 2/10 |
| 5,471,684 | 12/1995 | Casale | 2/195.1 |

*Primary Examiner*—Diana Biefeld
*Attorney, Agent, or Firm*—Cahill, Sutton & Thomas

[57] ABSTRACT

A hat having an attached accessory such as a visor is disclosed incorporating a headband formed integrally with a sliding member positioned adjacent the opening in the crown. A track is secured to the crown and slidingly engages the sliding member to permit the crown and attached visor to be rotated relative to the wearer's head without removing the hat.

4 Claims, 2 Drawing Sheets

SLIDABLY REPOSITIONABLE HAT

The present invention pertains to hats, and more particularly to hats whose orientation with respect to the wearer's head may be changed without removing the hat.

BACKGROUND OF THE INVENTION

Hats or caps frequently incorporate accessories such as brims, peaks, bills or visors that extend from a particular peripheral portion of the cap. Further, it is sometimes desirable to change the specific orientation of the hat with respect to the wearer such as by repositioning the visor or perhaps repositioning a hat accessory such as ear covers or muffs or ear speakers. With particular reference to hats incorporating a visor, the visor is normally directed forwardly of the wearer with the chief intent to shade the wearer's eyes. Under some conditions, and with respect to some sports, it is desirable or necessary to wear the hat with the visor directed rearwardly of the wearer. For example, when occupied in a sporting event wherein a significant wind may be encountered directed frontally of the wearer, such as boating, it may be necessary to reverse the hat and position the visor rearwardly of the wearer to prevent the onrushing wind from lifting the hat from the wearer's head.

Typically, to reverse the visor of such hat requires that the hat be removed and replaced on the head with the visor facing rearwardly. This maneuver is not always easily accomplished, particularly during the time when concentration is required elsewhere. For example, boating, skiing, and the like, require that the adjustment be made rapidly and that the hat be replaced on the head firmly in the proper position. Further, with regard to those hats that are manufactured and sold according to size, there is usually a label or tag at the central rear portion of the headband that is frequently relatively stiff and can irritate the forehead if the hat is reversed. In those instances where the hat includes an adjustable headband, the adjustable overlap of the headband is sometimes intrusive and can also irritate the forehead of the wearer when the hat is reversed.

OBJECTS OF THE INVENTION

It is therefore an object of the present invention to provide a hat having a means for repositioning a portion of the hat, such as a visor, relative to the wearer's head.

It is also an object of the present invention to provide a hat having a means for reorienting the hat with respect to the wearer's head without removing the hat.

It is also an object of the present invention to provide a hat incorporating a visor that may be positioned forwardly or rearwardly of the wearer after the hat has been positioned on the wearer's head without removing the hat to reorient the visor.

It is also an object of the present invention to provide a hat incorporating a headband forming a part of a track/slider mechanism to permit the headband to remain firmly on the wearer's head while the hat is rotated about the head.

It is still another object of the present invention to provide a hat having a visor that can be repositioned with respect to the wearer's head while the hat remains on the wearer's head.

These and other objects of the present invention will become apparent to those skilled in the art as the description proceeds.

SUMMARY OF THE INVENTION

Briefly, in accordance with the embodiment chosen for illustration, a hat or cap is provided with a means for orienting a visor with respect to the head of the wearer without removing the hat; the visor and crown of the hat are mounted with respect to the headband to permit sliding relative motion therebetween. A track member is secured to the interior of the hat opposite the headband to provide a means for slidably containing a sliding member therewithin. The sliding member is secured to the headband so that when the headband is positioned on the wearer's head it remains in a fixed position while the visor may be rotated or reoriented by causing sliding motion between the sliding member and the track. The headband remains in position on the wearer's head and thus remains comfortably and accurately positioned and also remains secure while the visor is reoriented with respect to the wearer. Further, very little motion is required by the wearer to create such an adjustment and thus the reorientation does not significantly detract from his concentration.

The present invention may more readily be described by reference to the accompanying drawings in which.

Detailed Description of the Preferred Embodiment

Figure 1:
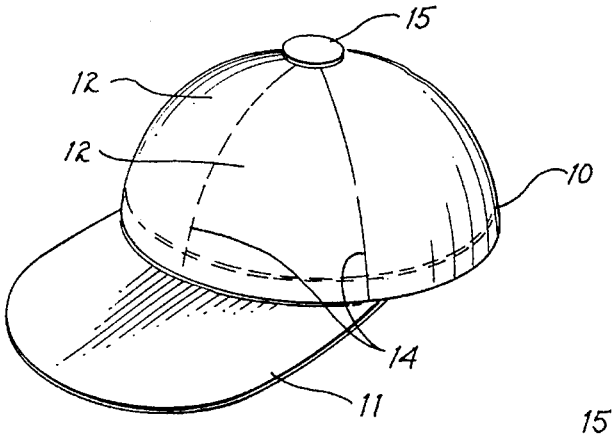
FIG. 1 is a perspective view of a sports hat incorporating the teachings of the present invention.
Figure 2:
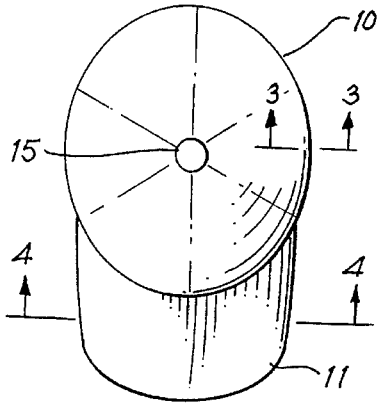
FIG. 2 is a top view of the hat of FIG. 1.

Referring now to FIGS. 1 and 2, a perspective view of a sports cap is shown having a crown 10 with an attached visor 11. Typically, the crown is formed of a plurality of segments 12 that are sewn along seams 14 to provide a domed hat or cap for covering the top of the wearer's head. The intersection of the stitching 14 at the top of the hat is usually covered with a button or knob 15 that may be sewn or stapled to the crown.

A visor 11 extends from the crown in a direction that would normally provide shade for the wearer's eyes. The visor may extend substantially horizontally or at a desired angle with respect to a vertical axis passing through the button 15. The purpose for which the hat is to be used may dictate varying shapes, lengths and angles with respect to the visor. For example, it is common for sports hats that are to be worn for extended periods of time in the sunlight, particularly on or near water, to incorporate visors of substantial length so that the shadow cast by the visor will protect the wearer's face. Further, the visor may be slightly curved in a transverse direction with respect to the crown in a manner to be described more fully hereinafter. A hat accessory, such as ear covers or stereo speakers, may be positioned laterally of the wearer's head adjacent the wearer's ears.

The visor 11 is typically formed of a fabric material that is stitched to, or contains, a stiffening material such as cardboard or plastic. The fabric of the visor is normally extended into and is sewn to the crown material in a manner well known in the art. Further, a sweatband or headband normally would circumvent the interior opening of the crown.

Figure 3:
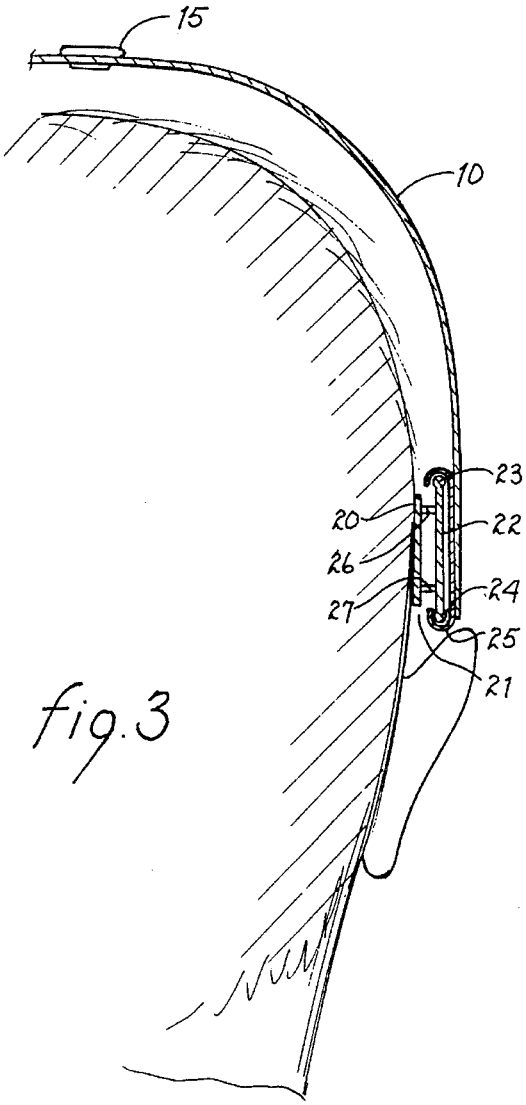
FIG. 3 is a cross-sectional view, enlarged, taken along line 3—3 of FIG. 2.

In the embodiment chosen for illustration, and as shown in FIG. 3, the headband or sweatband 20 circumscribes and contacts the wearer's head and is positioned in the opening 21 in the crown provided to receive the wearer's head. The headband may be made from an extruded plastic material and may be covered in a fabric or a leather-like material (not shown) for the wearer's comfort. In the embodiment shown in FIG. 3, the headband is formed integrally with and may be extruded with a sliding member 22 which supports a top and bottom slider edges 23 and 24, respectively. The slider edges 23 and 24 are positioned within a track 25 that is formed having a channel-shaped cross-section and may similarly be constructed from an extruded plastic material. Therefore, the slider edges 23 and 24 are captured or are partially enclosed within and remain in sliding contact with the track 25. The sliding member 22, and the integral slider edges 23 and 24 are maintained an appropriate distance from the headband 20 by spacers 26 and 27 to permit appropriate clearance between the track 25 and the wearer's head. The track is secured to the inner, lower portion of the crown by stitching, cementing, or other known techniques for securing a plastic material to a fabric.

The wearer therefore places the hat upon his or her head with the headband 20 in firm contact therewith. The visor 11 will normally extend forwardly of the wearer to provide shade to the wearer's eyes. When it is desired to reorient the visor, such as when it becomes necessary to prevent the wind from lifting the hat from the head, or such as when it becomes necessary to rapidly look upwardly to follow a flying ball for example, the visor may rapidly be rotated with respect to the wearer without removing the hat and without disturbing the headband. The visor can be repositioned by simply pushing or pulling it to the side causing the track and sliding member to translate with respect to each other. It may be noted that since the hat is not circular (when viewed from the top) the relative translation between the sliding member and the track requires a bending of the track generally in a horizontal plane or in a plane perpendicular to its linear motion. Thus, sufficient friction is assured to maintain the orientation of the visor in a given direction to thus prevent such movement of the visor unless it is deliberately reoriented by the wearer.

Figure 4:
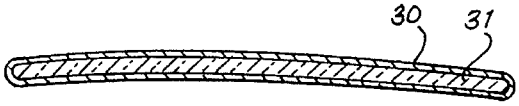
FIG. 4 is a cross-sectional view, enlarged, taken along line 4—4 of FIG. 2.
Figure 5:
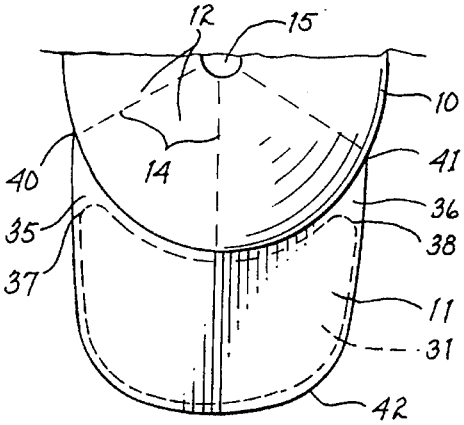
FIG. 5 is a top view of a sports hat showing an insert or stiffening member in the visor.

FIG. 4 shows a cross-section of a typical visor wherein it may be seen that the fabric 30 of the visor encases a stiffening member 31 which may be formed of a thin plastic or cardboard. The visor may be pre-formed to exhibit a slight curvature as shown in FIG. 4 or may be completely flat. It is typical for the stiffener 31 and the fabric to be secured together by stitching (not shown) which may be provided in a decorative format. It has been found that the intersection of the visor with the crown may present an impediment to the reorientation of the visor with respect to the crown. Referring to FIG. 5, it has been found that when a stiffening member extends into the area shown at 35 and 36, the track and sliding member at the juncture of the visor and the crown are forced to slightly fold and thus present a discontinuity to the generally smooth bending of the sliding member and track. This slight discontinuity or irregularity in the bending exhibits a tendency to cause the sliding member and track to bind and inhibit smooth and easy sliding motion. Therefore, the stiffening member 31 of the present invention extends substantially about the entire area of the visor but incorporates foreshortened laterally opposed corners 37 and 38 that extend toward but do not reach the lateral intersections 40 and 41 of the outer edge 42 of the visor 11 and the crown 10.

Figure 6:
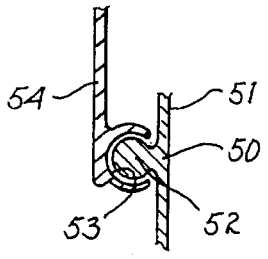
FIG. 6 is a cross-sectional view of an alternative track and slider configuration that may be incorporated in the teachings of the present invention.
Figure 7:
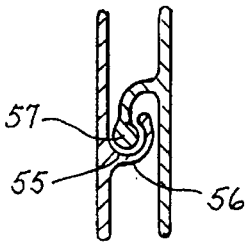
FIG. 7 is another cross-sectional view of an alternative track and slider configuration that may be incorporated in the teachings of the present invention.
Figure 8:
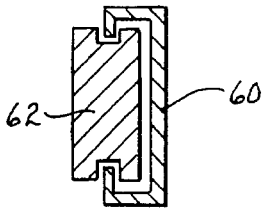
FIG. 8 is also another cross-sectional view of an alternative track and slider configuration that may be incorporated in the teachings of the present invention.

Referring to FIGS. 6, 7 and 8, alternative structures for use as sliding members and tracks may be shown. In FIG. 6, the headband 50 is formed of an extruded plastic material having a flat surface 51 for contacting the wearer's head and including a single rail 52 that may be "snapped" into a corresponding channel 53 provided in a track 54. The structure of FIG. 6 may provide some advantages and ease of adjustment in that the track and sliding mechanism may be snapped together; however, it is believed that sliding motion will be less smooth than in the preferred embodiment shown in FIG. 3. Similarly, FIG. 7 permits the respective portions of the sliding member and track to be snapped together with a vertical motion. Referring to FIG. 7, a headband 55 is provided with an extruded upwardly opening channel 56 that receives a downwardly extending sliding member 57. The member 57 and the opening 56 can be proportioned to be a snap fit. FIG. 8 illustrates another configuration of a track and sliding member mechanism wherein the track 60 is formed of an opened shape channel to slidingly receive and support a sliding member 62. The channel 60 can be formed of an extruded plastic material while the sliding member 62 may preferably be formed of a softer rubber-like material that can form a comfortable basis for a headband.

It may be noted that the above designations of the various track and track configurations as well as the sliding members may be reversed. That is, either the sliding member or the track member may be utilized as the headband or be attached to or mounted on a headband. It is important, however, to note that the headband should remain relatively unmovable and in intimate contact with the wearer's head during all relative motion of the sliding member and the track.

Figure 9:
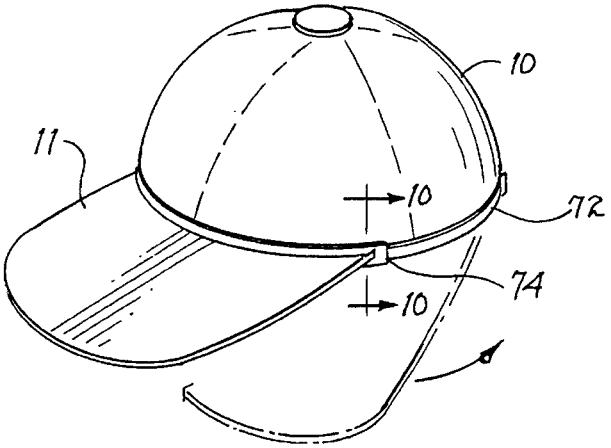
FIG. 9 is a perspective view of a sports hat showing an alternative embodiment of the present invention.
Figure 10:
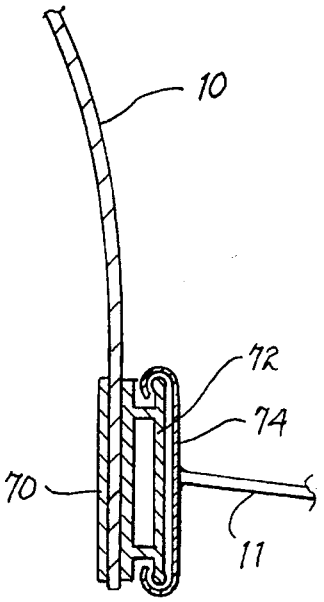
FIG. 10 is a cross-sectional view of FIG. 9 taken along line 10—10.

The above embodiments of the present invention have been described in terms of a stationary headband having a track and sliding member to permit the rotation of the hat and accessory or visor with respect to the headband and thus with respect to the wearer's head. In the embodiment shown in FIGS. 9 and 10, the hat crown and headband contact the wearer's head in a more conventional manner and remain stationary with respect to the wearer's head for so long as the hat is worn. However, the accessory or visor is secured to the crown through the utilization of a track and sliding member arrangement. Referring to FIG. 9, it may be seen that the crown 10 and visor 11 are secured to each other by means of a track and sliding member arrangement. Referring to FIG. 10, the crown 10 may include a conventional headband 70 secured internally of the crown adjacent the lower edge thereof. In the embodiment shown in FIG. 10, a sliding member 72 is secured externally of the crown 10 and slidably supports a track 74 which is attached to the visor 11. Again, care must be taken to insure that the stiffening member within the visor does not impede the relative sliding motion of the track and sliding member and thus the relative motion of the visor and the crown.

Figure 11:
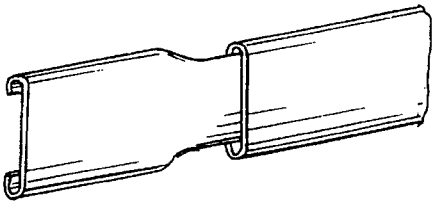
FIG. 11 is a perspective view of a suitable adjustment configuration for the track members of the present invention.

The hat of the present invention may be constructed in the conventional manner utilizing a variety of sizes to accommodate the specific size of the user's head. However, it is possible to incorporate variable headband sizes in the present invention by using well known techniques for shortening or extending the length of the headband. For example, using the structure described in connection with FIG. 3, the spacers 26 and 27, as well as the sliding member 22, can be omitted from a short distance at the rear of the hat while the headband 20 is provided with well known snaps and mating openings at the respective rear ends thereof. The track can be made to accommodate this extension or shortening of the slider by providing a telescoping end such as shown in FIG. 11 wherein the length of the headband may be adjusted using familiar techniques while the track adjusts automatically and will thus accommodate the lengthened or shortened headband and sliding member.

It will be apparent to those skilled in the art that many modifications may be made in the embodiments chosen for illustration. For example, the track members and the sliding members may be interchanged wherein each may form the basis for a headband while the other is attached to the crown to permit the relative sliding motion between the headband and the crown. Similarly, the materials with which the sliding members and the tracks are formed may be selected from a variety of well known materials to provide reasonably smooth sliding motion while maintaining the necessary shape without creating discomfort. Further, the sliding member or the tracks need not be continuous extrusions, but may instead be formed of discontinuous sections of the extrusions. Such discontinuous sections may take a variety of forms; for example, the slidable member may take the form of a plurality of buttons that slide within the confines of the extruded C-shaped track.

What is claimed is:

1. A hat comprising:

(a) a crown for covering at least a portion of a wearer's head and having an opening to receive a wearer's head;

(b) a headband positioned adjacent said opening for contacting a wearer's head and for supporting the crown;

(c) a sliding member secured to one of said headband and crown and positioned adjacent said opening;

(d) a track member secured to the other of said crown and headband, respectively, and slidably engaging said sliding member to permit relative sliding motion between said track member and sliding member and between said crown and a wearer's head; and (e) a visor secured to said crown to permit the visor to be repositioned relative to a wearer's head while said headband remains stationary.

2. The hat set forth in claim 1 wherein said visor forms an intersection with said crown between laterally opposed corners, and wherein said visor includes a stiffening member incorporating foreshortened laterally opposed corners that extend toward but do not reach said laterally opposed, corners of the intersection.

3. The hat set forth in claim 1 wherein said sliding member is formed of an extruded plastic material positioned a predetermined distance from said headband by spacers and having slider edges in sliding contact with said track member.

4. The hat combination set forth in claim 3 wherein said track member is formed from an extruded plastic material having a channel-shaped cross-section for partially enclosing said slider edges and for maintaining sliding contact therewith.

* * * * *